US009943457B2

(12) United States Patent
Starr

(10) Patent No.: US 9,943,457 B2
(45) Date of Patent: Apr. 17, 2018

(54) PATIENT TRANSFER APPARATUS AND METHOD

(71) Applicant: General Electric Company, Schenectady, NY (US)

(72) Inventor: Karen Starr, Monkton, MD (US)

(73) Assignee: General Electric Company, Schenectady, NY (US)

( * ) Notice: Subject to any disclaimer, the term of this patent is extended or adjusted under 35 U.S.C. 154(b) by 704 days.

(21) Appl. No.: 14/463,862

(22) Filed: Aug. 20, 2014

(65) Prior Publication Data

US 2016/0051424 A1 Feb. 25, 2016

(51) Int. Cl.
*A61G 7/10* (2006.01)

(52) U.S. Cl.
CPC ..... *A61G 7/1023* (2013.01); *A61G 2200/14* (2013.01)

(58) Field of Classification Search
CPC ..... A61G 1/048; A61G 1/00; A61G 11/00; A61G 2200/327; A61G 2200/14; A61G 2203/46; A61G 2203/30; A61G 1/04; A61G 1/003; A61G 1/042; A61G 7/1023; A61G 1/01; A61G 1/013; A61G 2200/32; A61B 5/0456; A61B 5/044; A61B 5/746; A61B 8/4227; A61B 8/06; A61B 8/5223; A61B 5/6892; A61B 5/702; A61B 5/02438; A61B 5/04085; A61B 7/04; A61B 5/7278; A61B 5/0245; A61B 8/02; A61B 2503/045; A61B 5/742; A47D 13/02; A47D 15/008; A61F 5/3761; A61F 5/3776

USPC ..... 128/870, 869, 846; 224/153, 159, 160, 224/584, 577, 151 R, 101, 158; 5/652, 5/655, 625–629; 600/22, 21; 294/140, 294/141, 142, 156, 150, 155

See application file for complete search history.

(56) References Cited

U.S. PATENT DOCUMENTS

| | | | | |
|---|---|---|---|---|
| 2,846,699 | A * | 8/1958 | Watson | A47D 13/02 224/158 |
| 3,096,917 | A * | 7/1963 | Ingvard | A47D 13/02 294/140 |
| 4,717,056 | A * | 1/1988 | Carmichael | A47D 13/02 2/69.5 |
| 5,333,769 | A * | 8/1994 | Skroski | A47D 5/006 224/148.5 |
| 9,326,619 | B2 * | 5/2016 | Krass | A47D 13/02 |
| 2008/0313812 | A1 * | 12/2008 | Reeves | A47D 13/02 5/655 |
| 2013/0340770 | A1 | 12/2013 | Starr et al. | |
| 2015/0265066 | A1 * | 9/2015 | Krass | A47D 13/02 224/158 |

* cited by examiner

*Primary Examiner* — Tarla Patel
(74) *Attorney, Agent, or Firm* — Andrus Intellectual Property Law, LLP

(57) ABSTRACT

The present application discloses a transfer device for an infant patient. The transfer device comprises a center section positionable beneath the patient, a first side section connected to the center section, and a second side section connected to the center section. The first side section and the second side section are movable toward each other such that the first and second side sections substantially surround the patient and form an abdominal access area.

8 Claims, 4 Drawing Sheets

PATIENT TRANSFER APPARATUS AND METHOD

BACKGROUND OF THE INVENTION

The subject matter disclosed herein relates to an infant patient transfer device, and more specifically to a transfer device which provides abdominal area access.

Following birth, access to the abdominal area, including the umbilical cord or stump, of an infant patient may be critical. Newborn heart rate can be reflected via umbilical cord pulsations accessed at the umbilical cord base. Medical interventions, such as umbilical catheter placement to the umbilical vein or artery, or the securing of pouches for abdominal wall defects may require abdominal area access as well. Additionally, access to the abdominal area may allow for delayed cord clamping which is increasing in practice.

The current practice includes cutting and securing the umbilical cord following delivery and then transferring the infant patient in a blanket to the mother's chest or to a radiant warmer. If access to the abdominal area is needed for a medical intervention or other reason, the infant patient would be placed, unwrapped, on the radiant warmer.

Therefore, a neonatal care device allowing for access to the infant patient's abdominal area is desired while supporting newborn thermal stabilization adjacent to the mother or during transport of the infant patient.

BRIEF DESCRIPTION OF THE INVENTION

The above-mentioned shortcomings, disadvantages and problems are addressed herein which will be understood by reading and understanding the following specification.

In an embodiment, a transfer device for an infant patient is provided comprising a center section positionable beneath the patient, a first side section connected to the center section, and a second side section connected to the center section. The first side section and the second side section are movable toward each other such that the first and second side sections substantially surround the patient and form an abdominal access area.

In another embodiment, a transfer device for an infant patient is provided comprising a center section positionable beneath the patient and a first side section connected to the center section, the first side section including a first handle. The transfer device also comprises a second side section connected to the center section and including a second handle; and an abdominal access. The first and the second side sections are movable toward each other such that the first and second handles are located proximate to each other and when the first and second side sections surround the patient, the abdominal access is positioned in proximity to a patient's abdomen.

In another embodiment, a method of accessing an abdomen of an infant patient during transport is provided. The method comprises positioning a center section of a patient transfer device beneath the patient, the transfer device comprising a first side section and a second side section, the first side section and the second side section connected to the center section. The method also comprises moving the first and second side sections toward each other to substantially surround the patient and forming an abdominal access to expose the patient's abdomen.

Various other features, objects, and advantages of the invention will be made apparent to those skilled in the art from the accompanying drawings and detailed description thereof.

DETAILED DESCRIPTION OF THE INVENTION

In the following detailed description, reference is made to the accompanying drawings that form a part hereof, and in which is shown by way of illustration specific embodiments that may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken as limiting the scope of the invention.

Figure 1:
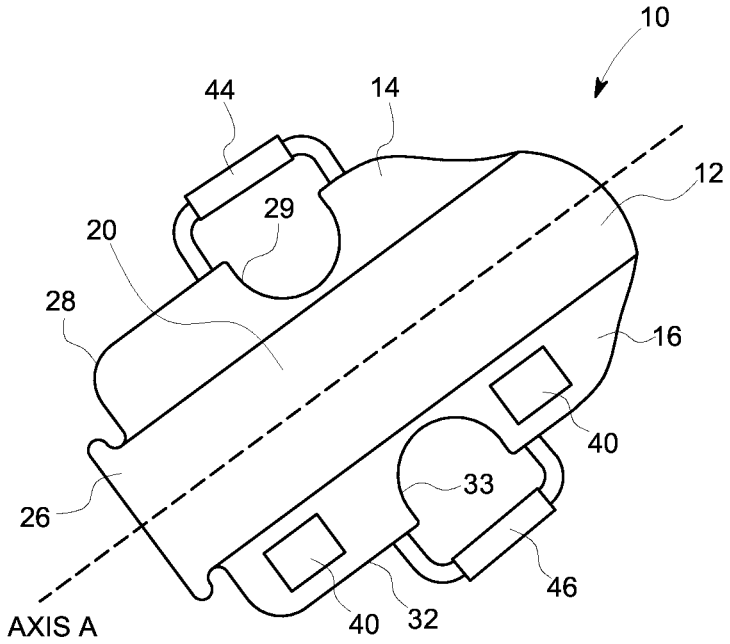
FIG. 1 is an interior perspective view of a first embodiment of a patient transfer device of the present disclosure.

FIG. 1 illustrates an embodiment of a patient transfer device 10 of the present disclosure in a first condition. The patient transfer device 10 can be used to handle an infant patient, such as a newborn or neonate, and to transfer the infant patient from one location to another while minimizing physical contact between a physician or caregiver and the patient while still providing physical and thermal support to the infant patient.

The patient transfer device 10 comprises a center section 12, a first side section 14 connected to the center section 12, and a second side section 16 connected to the center section 12, which are all coplanar in the first condition shown in FIG. 1. In the depicted embodiment, the second side section 16 is connected to the center section 12 opposite the first side section 14, but other configurations of the first and second sides 14, 16 with respect to the center section 12 may be envisioned. In some embodiments, such as that depicted in FIG. 1, the patient transfer device 10 may also comprise an end portion 26. However, the end portion 26 could be eliminated while also operating within the scope of the present disclosure.

Figure 2:
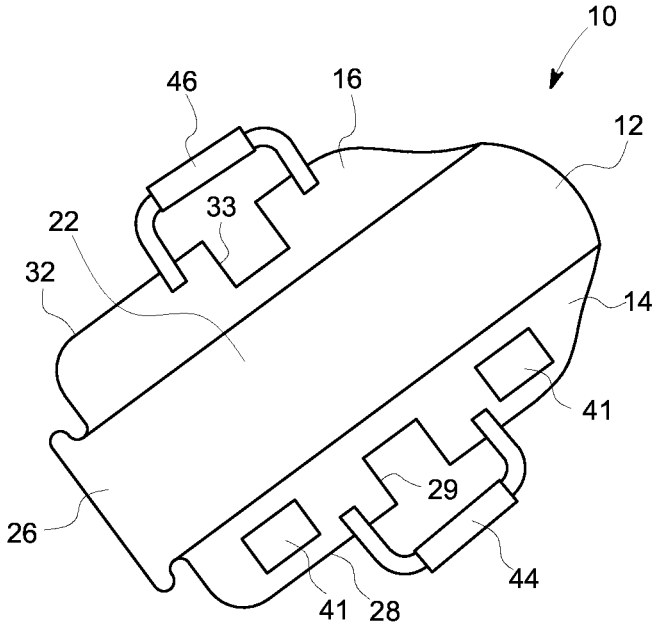
FIG. 2 is an exterior perspective view of an embodiment of the patient transfer device.

The patient transfer device 10 has an interior side 20 (as depicted in FIG. 1), which is adapted to receive and be in general contact with an infant patient, and an opposing exterior side 22 (as depicted in FIG. 2).

The first side section 14 may have a longitudinal edge 28. The longitudinal edge 28 of the first side section 14 may be opposite the center section 12. It should be appreciated that various embodiments of longitudinal edge 28 are envisioned. For example, in the embodiment depicted in FIG. 1, the longitudinal edge 28 is substantially straight, extends substantially along the length of the patient transfer device 10, and is substantially parallel to Axis A. In another embodiment, the longitudinal edge 28 may be wavy or scalloped, or have a non-uniform geometry. In another embodiment, the longitudinal edge 28 may extend along only a portion of the length of the patient transfer device 10. In yet another embodiment, the longitudinal edge 28 may not run parallel to Axis A, but may extend at an angle with respect to Axis A.

The first side section 14 may have an indentation 29 on the longitudinal edge 28. In the embodiment depicted in FIG. 1, the indentation 29 is U-shaped. However, it should be appreciated that other geometries of the indentation 29 may be envisioned. For example, the indentation 29 may be rectangular or slot-like as depicted in FIG. 2. In yet another example, the indentation 29 may be semi-circular, or it may have an irregularly or non-uniformly curved or angular geometry.

In the embodiment depicted in FIG. 1, the indentation 29 is positioned approximately along the middle of the longitudinal edge 28. It should be appreciated, however, that other positions of the indentation 29 may be envisioned. For example, the indentation 29 may be positioned along the longitudinal edge 28 so as to be in proximity to the abdomen of an infant patient once the infant patient is positioned on the patient transfer device 10.

Similar to the first side section 14, the second side section 16 may have a longitudinal edge 32. The longitudinal edge 32 of the second side section 16 may be opposite the center section 12. It should be appreciated that various embodiments of longitudinal edge 32 are envisioned. For example, in the embodiment depicted in FIG. 1, the longitudinal edge 32 is substantially straight, extends substantially along the length of the patient transfer device 10, and is substantially parallel to Axis A. In another embodiment, the longitudinal edge 32 may be wavy or scalloped, or have a non-uniform geometry. In another embodiment, the longitudinal edge 32 may extend along only a portion of the length of the patient transfer device 10. In yet another embodiment, the longitudinal edge 32 may not extend at an angle with respect to Axis A.

The second side section 16 may have an indentation 33 on the longitudinal edge 32. Indentation 33 could be eliminated while also operating within the scope of the present disclosure. As depicted in FIG. 1, the indentation 33 is u-shaped. However, it should be appreciated that other geometries of the indentation 33 may be envisioned. For example, the indentation 33 may be rectangular or slot-like as depicted in FIG. 2. In yet another example, the indentation 33 may be semi-circular or it may have an irregularly or non-uniformly curved or angular geometry. It should also be appreciated that indentations 29, 33 are depicted in FIGS. 1 and 2 having similar geometries to one another, but it may be envisioned that indentations 29, 33 have unique geometries compared to one another.

In the embodiment depicted in FIGS. 1 and 2, the indentation 33 is positioned approximately along the middle of the edge 32. It should be appreciated, however, that this position may vary. The indentation 33 may be positioned to be in proximity to the abdomen of the patient once the patient is positioned on the patient transfer device 10.

As depicted in FIGS. 1 and 2, indentations 29 and 33 are located approximately in equivalent positions along longitudinal edges 28 and 32, respectively. However, it should be appreciated that the positioning of indentations 29, 33 may be overlapping or non-overlapping when in proximity to one another.

As depicted in the embodiments of both FIGS. 1 and 2, the first side section 14 includes a handle 44 and the second side section 16 includes a handle 46. Handles 44, 46 may be connected to, and spaced apart from, the first and second side sections 14, 16, respectively. However, it should be appreciated that other embodiments of handles 44, 46 are envisioned. For example, the handles 44, 46 could be connected to the center section 12 and sized so that the handles 44, 46 could be brought together about first and second side sections 14, 16. In yet another example, handles 44, 46 may be integral to the respective first and second side sections.

In FIG. 2, the exterior side 22 of the patient transfer device 10 in accordance with an embodiment is shown. The patient transfer device 10 depicted in FIG. 2 is generally similar to that depicted in FIG. 1 with the exception to the geometry of indentations 29, 33.

As depicted in FIGS. 1 and 2, the first and second side sections 14, 16 include fasteners 40, 41. Fasteners 40, 41 are opposite portions of a hook and loop fastener, such as Velcro®. The physical engagement between fasteners 40, 41 allows the first and second side sections 14, 16 to be releasably coupled. Although a hook and loop fastener are shown in this embodiment, it should be understood that different types of fasteners could be utilized while operating within the scope of the present disclosure. It should also be appreciated that various arrangements of fasteners 40, 41 may be envisioned. For example, fasteners 40 may be positioned on the interior side 20 of first side section 14 and fasteners 41 may be positioned on the exterior side 22 of second side section 16. The positioning of fasteners 40, 41 on first and second side sections may also vary in other embodiments. Additionally, there may be more or fewer fasteners 40, 41 on the first and second side sections 14, 16.

Figure 3:
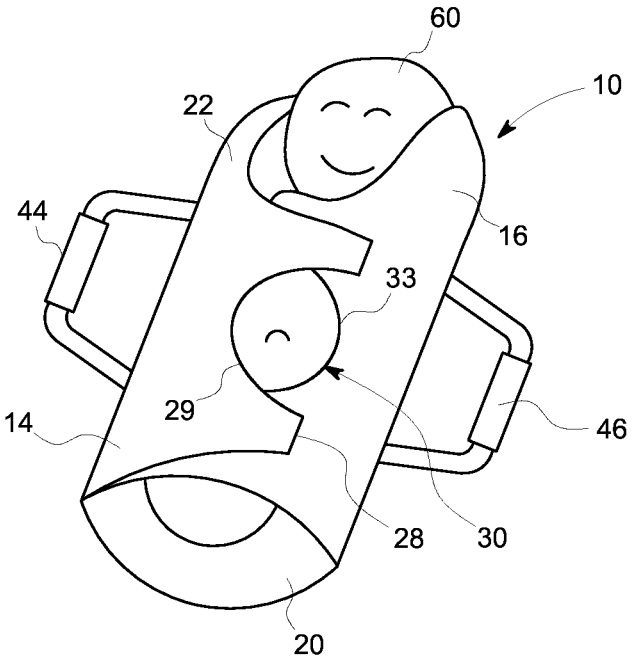
FIG. 3 is a view showing the transport of an infant patient using an embodiment of the patient transfer device of the present disclosure.

Having described exemplary components of the patient transfer device 10 in accordance with FIGS. 1 and 2, the operation of the patient transfer device 10 will now be described in accordance with an embodiment. In the embodiment depicted in FIG. 3, an infant patient 60 can be placed on the interior side 20 of the center section 12. If present, the end portion 26 (not pictured) can be brought up to cover the infant patient's feet. First and second side sections 14, 16 can be brought towards one another to surround the infant patient 60 in a second condition shown in FIG. 3. In the depicted embodiment, second side section 16 is wrapped around the infant patient 60 first and then the first side section 14 is wrapped around the infant 60. The first and second side sections 14, 16 may be releasably coupled in this position by fasteners 40, 41. However, depending on the configuration of fasteners 40, 41, the first side section 14 may be wrapped around the infant patient 60 before wrapping second side section 16 around the infant patient 60. In this position, the first and second side sections 14, 16 may overlap with the indentations 29, 33 aligning in an overlapping manner. The overlap of indentations 29, 33 may form an abdominal access area 30, wherein the patient's 60 abdomen is exposed. The abdominal access area 30 exposes the infant patient's abdomen including the patient's umbilical cord or stump. In an embodiment where the infant transfer device comprises only a first indentation 29, the indentation may form the abdominal access area 30. The abdominal access area 30 allows for medical professionals to measure heart rate at the umbilical cord base, conduct medical interventions near the abdomen or delay cord clamping.

When the infant patient 60 is supported by the patient transfer device 10, and the first and second side sections 14, 16 are in proximity to one another, a clinician or other individual can grasp the pair of handles 44, 46 with a single hand (not pictured) and lift the infant patient 60 for transport and/or movement, while the patient's abdomen is exposed at the abdominal access area 30. In this embodiment, the patient transfer device 10 does not restrict or limit access to the infant patient's abdominal area, but instead exposes the abdomen.

Figure 4:
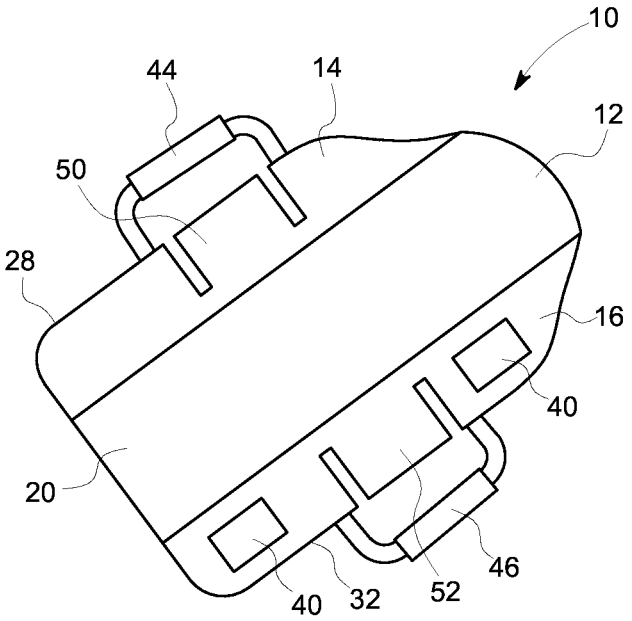
FIG. 4 is an interior perspective view of an embodiment of a patient transfer device of the present disclosure.
Figure 5:
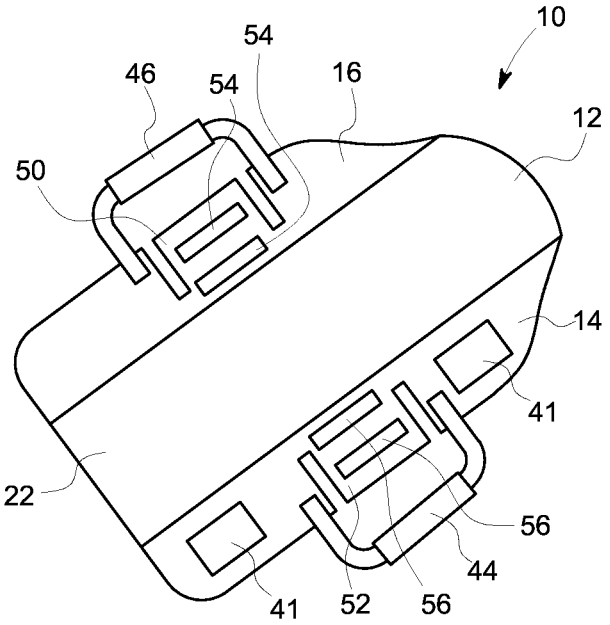
FIG. 5 is an exterior perspective view of an embodiment of the patient transfer device.

Turning to FIGS. 4 and 5, another embodiment of the infant transfer device 10 is depicted.

The patient transfer device 10 comprises a center section 12, a first side section 14 connected to the center section 12, and a second side section 16 connected to the center section 12. In the depicted embodiment, the second side section 16 is connected to the center section 12 opposite the first side section 14, but other configurations of the first and second sides 14, 16 with respect to the center section 12 may be envisioned. In some embodiments, the patient transfer device 10 may also comprise an end portion 26 (as shown in FIGS. 1 and 2). However, the end portion 26 could be eliminated (as depicted in FIGS. 4 and 5) while also operating within the scope of the present disclosure.

The patient transfer device 10 has an interior side 20 (as depicted in FIG. 4), which is adapted to receive and be in general contact with an infant patient, and an opposing exterior side 22 (as depicted in FIG. 5).

Figure 6:
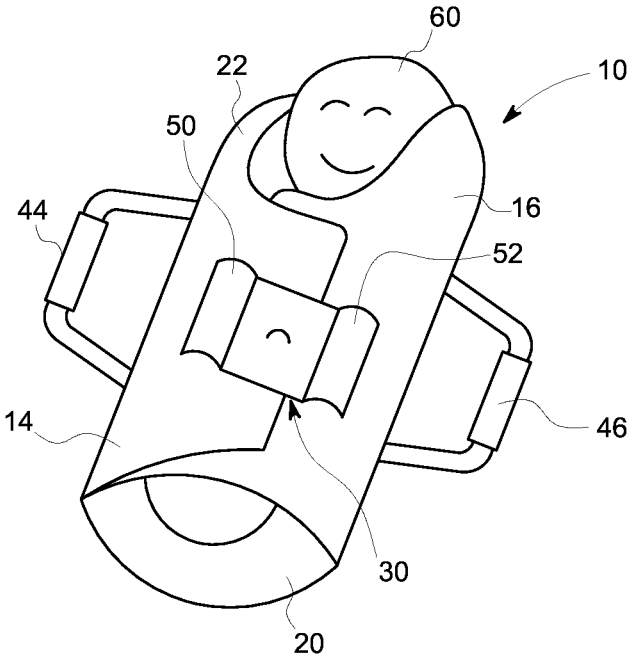
FIG. 6 is a view showing the transport of an infant patient using an embodiment of the patient transfer device of the present disclosure.

The first side section 14 may include a first flap 50 and the second side section may include a second flap 52. The first and second flaps 50, 52 may be flexible. First and second flaps 50, 52 are configurable in a closed position (as depicted in FIGS. 4 and 5), and in an open position (as depicted in FIG. 6). It should be appreciated that the embodiment depicted in FIGS. 4-6 includes first and second flaps 50, 52, but the patient transfer device 10 may comprise more flaps or fewer flaps.

First flap 50 may comprise flap fasteners 54. Second flap 52 may comprise flap fasteners 56. Flap fasteners 54, 56 are configured to selectively retain the first and second flaps 50, 52, respectively, in the open position. Fasteners 54, 56 include opposite portions of a hook and loop fastener, such as Velcro®. The physical engagement between fasteners 54 or 56 allows the first and second flaps to be selectively retained in the open position. Although a hook and loop fastener are shown in this embodiment, it should be understood that different types of fasteners could be utilized while operating within the scope of the present disclosure. Additionally, it should be appreciated that different configurations and positions of fasteners 54, 56 may be envisioned.

As depicted in the embodiments of both FIGS. 4 and 5, the first side section 14 includes a handle 44 and the second side section 16 includes a handle 46. Handles 44, 46 may be connected to, and spaced apart from, the first and second side sections 14, 16. However, it should be appreciated that other embodiments of handles 44, 46 are envisioned. For example, the handles 44, 46 could be connected to the center section 12 and sized so that the handles 44, 46 could be brought together about first and second side sections 14, 16.

Having described exemplary components of the patient transfer device 10 in accordance with FIGS. 4 and 5, the operation of the patient transfer device 10 will now be described in accordance with an embodiment. In the embodiment depicted in FIG. 6, an infant patient 60 can be placed on the interior side 20 of the center section 12 and the first and second side sections 14, 16 can be brought towards one another to surround the infant patient 60. In the depicted embodiment, second side section 16 is wrapped around the infant patient 60 first and then the first side section 14 is wrapped around the infant 60.

Flaps 50, 52 may initially be in the closed position, wherein the abdomen of the infant patient 60 is not exposed (not pictured). To expose the abdomen of the infant patient, the abdominal access area 30 may be formed by positioning flaps 50, 52 in an open position as depicted in FIG. 6. The abdominal access area 30 exposes the infant patient's abdomen including the patient's umbilical cord or stump. It should be appreciated that the abdominal access area 30 may also be formed by positioning one of flaps 50 or 52 in the open position. Flaps 50, 52 may be releasably retained in the open position by fasteners 54, 56 respectively.

Figure 7:
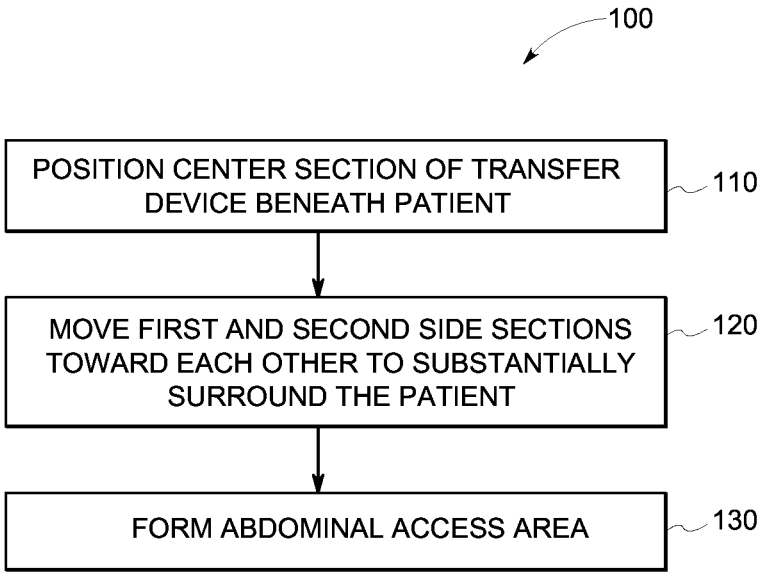
FIG. 7 is a flowchart of a method of accessing an abdomen of an infant patient during transport in accordance with an embodiment of the present disclosure.

Referring back to FIGS. 1-6, the method 100 of utilizing the patient transfer device 10 of the present disclosure will now be described in connection with FIG. 7. Although the present method is being described as one preferred method of utilizing the patient transfer device 10, it should be understood that the patient transfer device 10 could be utilized in different ways depending on whether the abdominal access area is needed in the open or closed position and the desired size of the abdominal access area.

The method 100 may include a step 110 comprising positioning the center section 12 of a patient transfer device 10 beneath the patient 60. The transfer device 10 may comprise a first side section 14 and a second side section 16, the first side section 14 and the second side section 16 connected to the center section 12.

The method 100 may include a step 120 comprising moving the first and second side sections 14, 16 toward each other to substantially surround the patient 60. In one embodiment, step 120 comprises wrapping the second side section 16 around the infant patient 60 first and then wrapped the first side section 14 around the infant 60, thereby overlapping the first and second side sections 14, 16. In another embodiment, the first side section 14 may be wrapped around the infant patient 60 before the second side section 16 is wrapped around the infant patient 60.

The method 100 may also include a step 130 comprising forming an abdominal access area 30 to expose the patient's abdomen, including the patient's umbilical cord or stump. In one embodiment, the step 130 may comprise positioning an indentation 29 of at least the first side section 14 in proximity with the patient's abdomen to form the abdominal access area 30. In another embodiment, the step 130 may comprise positioning an indentation 29 and an indentation 33 in proximity with the patient's abdomen to form the abdominal access area 30. In yet another embodiment, the step 130 may comprise positioning at least a first flap 50 in proximity to the patient's abdomen and then positioning the flap 50 in an open position, thereby forming the abdominal access area 30 and exposing the patient's abdomen. In another embodiment, the step 130 may comprise positioning a first flap 50 and a second flap 52 in proximity to the patient's abdomen and positioning the flaps 50, 52 in an open position to form the abdominal access area 30.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

I claim:

1. A transfer device for an infant patient, comprising:

a center section positionable beneath the infant patient;

a first side section connected to the center section and including a longitudinal edge having an indentation extending into the first side section from the longitudinal edge; and a second side section connected to the center section and including a longitudinal edge having an indentation extending into the second side section from the longitudinal edge;

wherein the transfer device is movable between a first condition in which the center section, first side section and the second side section are generally coplanar and a second condition in which the first side section and the second side section substantially surround the infant patient and the indentations form an abdominal access area.

2. The transfer device of claim 1, wherein the indentations are at least one of U-shaped, semi-circular, angular or slot-like in geometry.

3. The transfer device of claim 1, further comprising a first handle connected to the first side section and a second handle connected to the second side section.

4. The transfer device of claim 3 wherein the first and second handles are located proximate to each other when the transfer device is in the second condition.

5. A method of accessing an abdomen of an infant patient during transport, comprising:

positioning a transfer device in a first condition in which a center section of a patient transfer device is beneath the infant patient, the transfer device comprising a first side section having a longitudinal edge having an indentation extending into the first side section from the longitudinal edge and a second side section having a longitudinal edge having an indentation extending into the second side section from the longitudinal edge, the first side section and the second side section connected to the center section and generally coplanar with the center section in the first condition; and moving the transfer device to a second condition in which first and second side sections substantially surround the infant patient; and forming an abdominal access area to expose the abdomen when the transfer device is in the second condition.

6. A transfer device for an infant patient, comprising:

a center section positionable beneath the infant patient;

a first side section connected to the center section and including a longitudinal edge having a first flap; and a second side section connected to the center section and including a longitudinal edge having a second flap;

wherein the transfer device is movable between a first condition in which the center section, the first side section and the second side section are generally coplanar and a second condition in which the first side section and the second side section substantially surround the infant patient, wherein when the transfer device is in the second condition, the first and second flaps are in a closed position to restrict access to an abdomen of the infant patient and when the first and second flaps are in an open position, the abdomen of the patient is exposed.

7. The transfer device of claim 6 further comprising a first handle connected to the first side section and a second handle connected to the second side section.

8. The transfer device of claim 6 wherein the first and second handles are located proximate to each other when the transfer device is in the second condition.

* * * * *